US007865111B2

(12) United States Patent
Fukuda

(10) Patent No.: US 7,865,111 B2
(45) Date of Patent: Jan. 4, 2011

(54) IMAGE FORMING UNIT AND IMAGE FORMING APPARATUS

(75) Inventor: Masahiro Fukuda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 182 days.

(21) Appl. No.: 12/219,998

(22) Filed: Jul. 31, 2008

(65) Prior Publication Data

US 2009/0052936 A1 Feb. 26, 2009

(30) Foreign Application Priority Data

Aug. 21, 2007 (JP) ..... 2007-214436

(51) Int. Cl.
*G03G 21/18* (2006.01)

(52) U.S. Cl. ..... 399/113

(58) Field of Classification Search ..... 399/107, 399/110, 111, 113, 114
See application file for complete search history.

(56) References Cited

U.S. PATENT DOCUMENTS 5,581,328 A * 12/1996 Yashiro ..... 399/111
6,923,586 B2 * 8/2005 Yoshihara ..... 400/692
7,400,845 B2 * 7/2008 Okoshi ..... 399/113
2006/0133850 A1 * 6/2006 Nishimura ..... 399/113

FOREIGN PATENT DOCUMENTS

| | | |
|---|---|---|
| JP | 07-248716 | 9/1995 |
| JP | 08-339152 | 12/1996 |
| JP | 10-319818 | 4/1998 |
| JP | 11-282323 | 10/1999 |
| JP | 2000-267371 | 9/2000 |
| JP | 2002-108089 | 4/2002 |
| JP | 2003-280490 | 10/2003 |
| JP | 2005-141111 | 6/2005 |
| JP | 2005-242067 | 9/2005 |
| JP | 2006-268064 | 10/2006 |

* cited by examiner

*Primary Examiner*—Hoan Tran
(74) *Attorney, Agent, or Firm*—Kubotera & Associates LLC

(57) ABSTRACT

An image forming unit includes a first image forming member; a second image forming member; a first unit for supporting the first image forming member to be freely rotatable; a second unit for supporting the second image forming member to be freely rotatable; and an image forming member urging member attached to one of the first unit and the second unit for urging the second image forming member toward the first image forming member when the first unit is connected to the second unit.

17 Claims, 18 Drawing Sheets

IMAGE FORMING UNIT AND IMAGE FORMING APPARATUS

BACKGROUND OF THE INVENTION AND RELATED ART STATEMENT

The present invention relates to an image forming unit and an image forming apparatus.

In a conventional image forming apparatus such as a printer, a copier, a facsimile, and the likes, a charge roller charges a surface of a photosensitive drum as a first image forming member, and an LED (Light Emitting Diode) head exposes the surface of the photosensitive drum to form a static latent image thereon. Then, a developing roller as a second image forming member attaches a thin layer of toner to the static latent image through static electricity, thereby forming a toner image. A transfer roller transfers the toner image to a sheet, thereby forming an image. After the transfer roller transfers the toner image to the sheet, a cleaning device removes toner remaining on the photosensitive drum (refer to Patent Reference).

Patent Reference: Japan Patent Publication No. 2002-108089

In the conventional printer, when it is difficult to accurately set a distance between an axis of the photosensitive drum and an axis of the developing roller due to a manufacturing variance, it is difficult to obtain a precise nip amount between the photosensitive drum and the developing roller, thereby deteriorating image quality.

Further, even though the distance between the axis of the photosensitive drum and the axis of the developing roller is controlled at a specific value in an initial stage of the conventional printer, an outer diameter of the photosensitive drum or the developing roller may decrease due to surface ware after the conventional printer is used for a long period of time. In this case, it is difficult to obtain a specific nip amount, thereby deteriorating image quality.

In view of the problem described above, an object of the invention is to provide an image forming unit and an image forming apparatus, in which it is possible to solve the problems of the conventional printer. In the image forming unit and the image forming apparatus of the present invention, it is possible to accurately obtain a specific nip amount between a first image forming member and a second image forming member.

Further objects of the invention will be apparent from the following description of the invention.

SUMMARY OF THE INVENTION

In order to attain the objects described above, according to an aspect of the present invention, an image forming unit includes a first image forming member; a second image forming member; a first unit for supporting the first image forming member to be freely rotatable; a second unit for supporting the second image forming member to be freely rotatable; and an image forming member urging member attached to one of the first unit and the second unit for urging the second image forming member toward the first image forming member when the first unit is connected to the second unit.

As described above, in the image forming unit of the present invention, when the first unit is connected to the second unit, the second image forming member is urged toward the first image forming member. Accordingly, it is possible to accurately obtain a specific nip amount between the first image forming member and the second image forming member, thereby improving image quality.

DETAILED DESCRIPTION OF THE PREFERRED EMBODIMENTS

Hereunder, embodiments of the present invention will be described in more detail with reference to the accompanying drawings. A printer will be explained as an image forming apparatus.

First Embodiment

Figure 2:
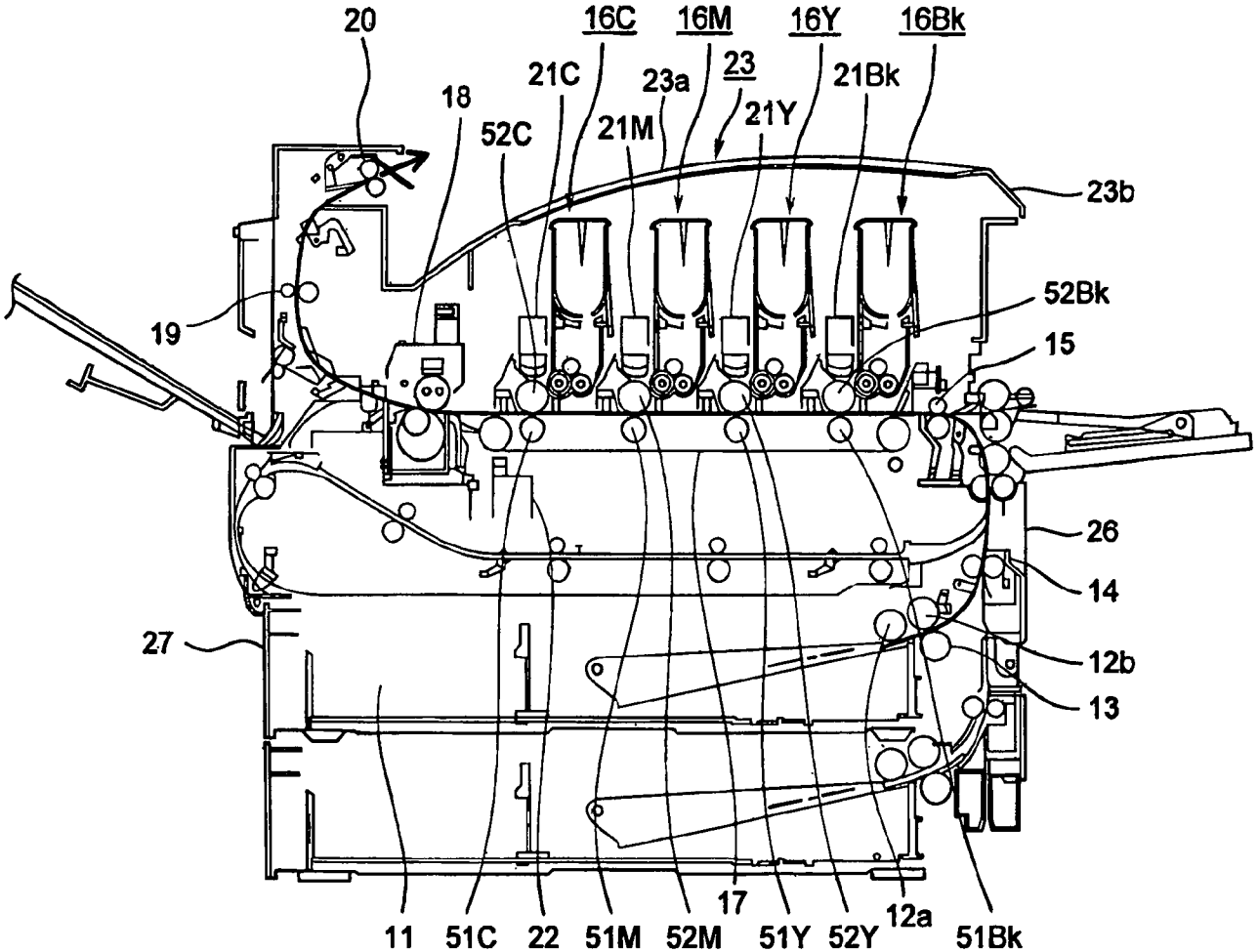
FIG. 2 is a schematic sectional view showing a printer according to the first embodiment of the present invention.

A first embodiment of the present invention will be explained. FIG. 2 is a schematic sectional view showing a printer according to the first embodiment of the present invention.

As shown in FIG. 2, the printer includes a top cover 23 as a top wall portion or an opening-closing member; a front cover 26 as a front wall portion; and a rear cover 27 as a rear wall portion. A sheet discharge cassette 23*a* as a recording medium discharge portion is disposed on an upper surface of the top cover 23. An operation panel 23*b* as an operational unit or a display unit is formed at an upper end portion of the front cover 26.

In the embodiment, the top cover 23 constitutes an upper housing, and the front cover 26, the rear cover 27, and a plate cover (not shown) as a sidewall portion constitute a lower housing. The upper housing and the lower housing constitute a housing.

In the embodiment, sheet supply cassettes 11 as a medium storage unit are disposed at a lower portion of the printer for storing a sheet (not shown) as a medium. A sheet supply unit is arranged adjacent to a front end portion of the sheet supply cassette 11 for separating and transporting the sheet one by one. In FIG. 2, the printer is provided with two sheet supply cassettes 11 as an expanded version.

In the embodiment, the sheet supply unit is formed of sheet supply rollers 12*a* and 12*b*, and a separation roller 13. The sheet supply unit transports the sheet to a resister roller 14 disposed above the sheet supply unit, and transports the sheet further to a transportation roller 15. Afterward, while a transportation belt 17 as a transportation member is moving to transport the sheet, the sheet passes through between a plurality of image forming units 16Bk, 16Y, 16M, and 16C for forming images in black, yellow, magenta, and cyan, respectively, and transfer rollers 51Bk, 51Y, 51M, and 51C as transfer members.

In the image forming units 16Bk, 16Y, 16M, and 16C, photosensitive drums 52Bk, 52Y, 52M, and 52C as image supporting members or first image forming members form toner images in each color as developer images. The transfer rollers 51Bk, 51Y, 51M, and 51C transfer the toner images to the sheet, thereby forming a color toner image.

Afterward, the sheet is transported to a fixing unit 18 as a fixing device. The fixing unit 18 fixes the color toner image to the sheet, thereby forming a color image. After the sheet is discharged from the fixing unit 18, a transportation roller 19 transports the sheet. Then, a discharge transportation roller 20 discharges the sheet outside a main body of the printer or an apparatus main body.

In the embodiment, LED (Light Emitting Diode) heads 12Bk, 12Y, 12M, and 12C as exposure devices are disposed to face the image forming units 16Bk, 16Y, 16M, and 16C for exposing surfaces of the photosensitive drums 52Bk, 52Y, 52M, and 52C to form static latent images.

The image forming units 16Bk, 16Y, 16M, and 16C are disposed to be detachable relative to the apparatus main body. To this end, the top cover 23 is disposed at an upper portion of the apparatus main body to be freely opened and closed. The top cover 23 constitutes the sheet discharge cassette 23*a* for placing the sheet thus discharged. The top cover 23 also supports the LED heads 12Bk, 12Y, 12M, and 12C. Further, a sensor unit 22 is disposed under the image forming unit 16C.

A configuration of the image forming units 16Bk, 16Y, 16M, and 16C will be explained next. The image forming units 16Bk, 16Y, 16M, and 16C have an identical configuration, and a configuration of the image forming unit 16Bk will be explained.

Figure 1:
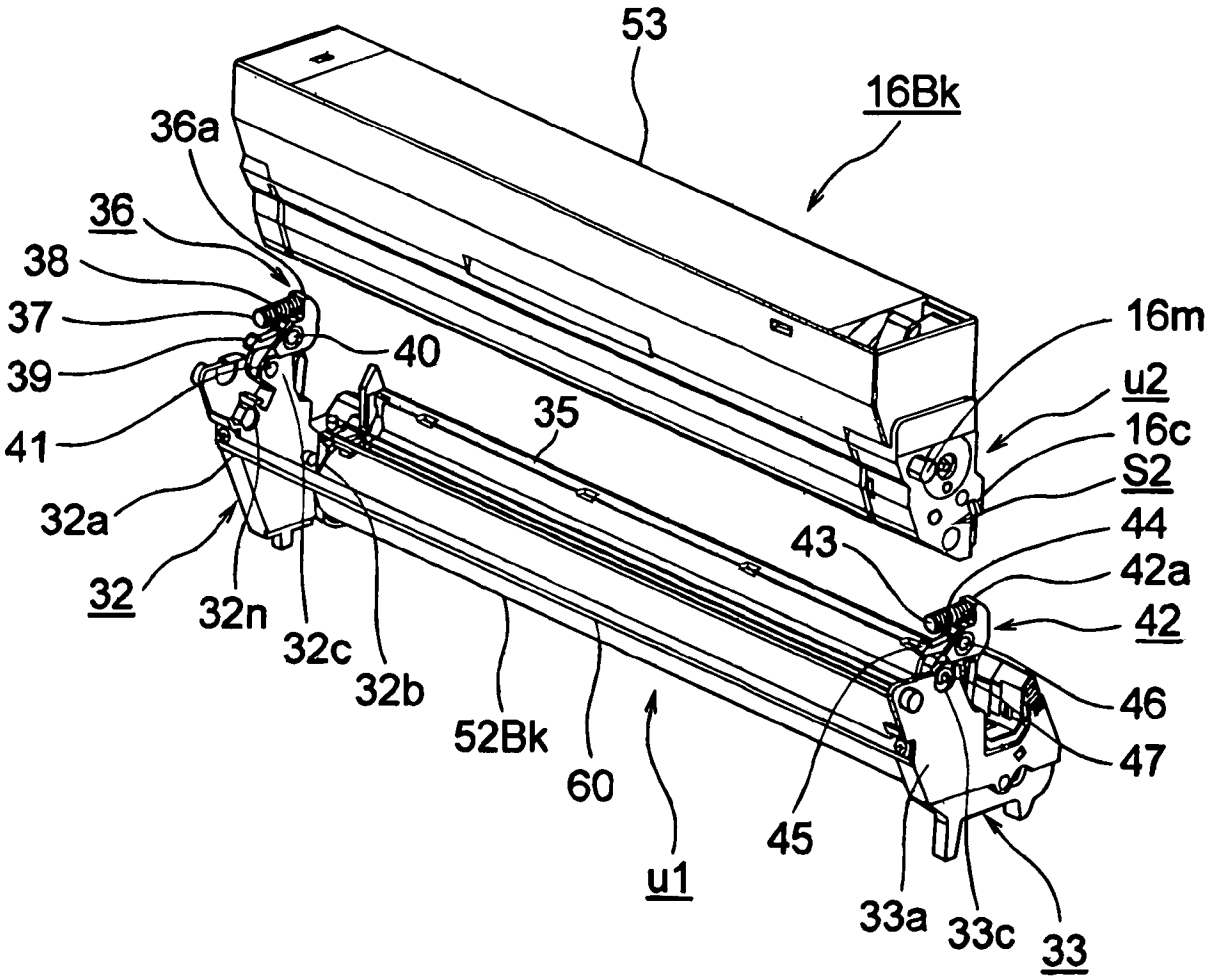
FIG. 1 is a schematic exploded perspective view No. 1 showing an image forming unit according to a first embodiment of the present invention.
Figure 3:
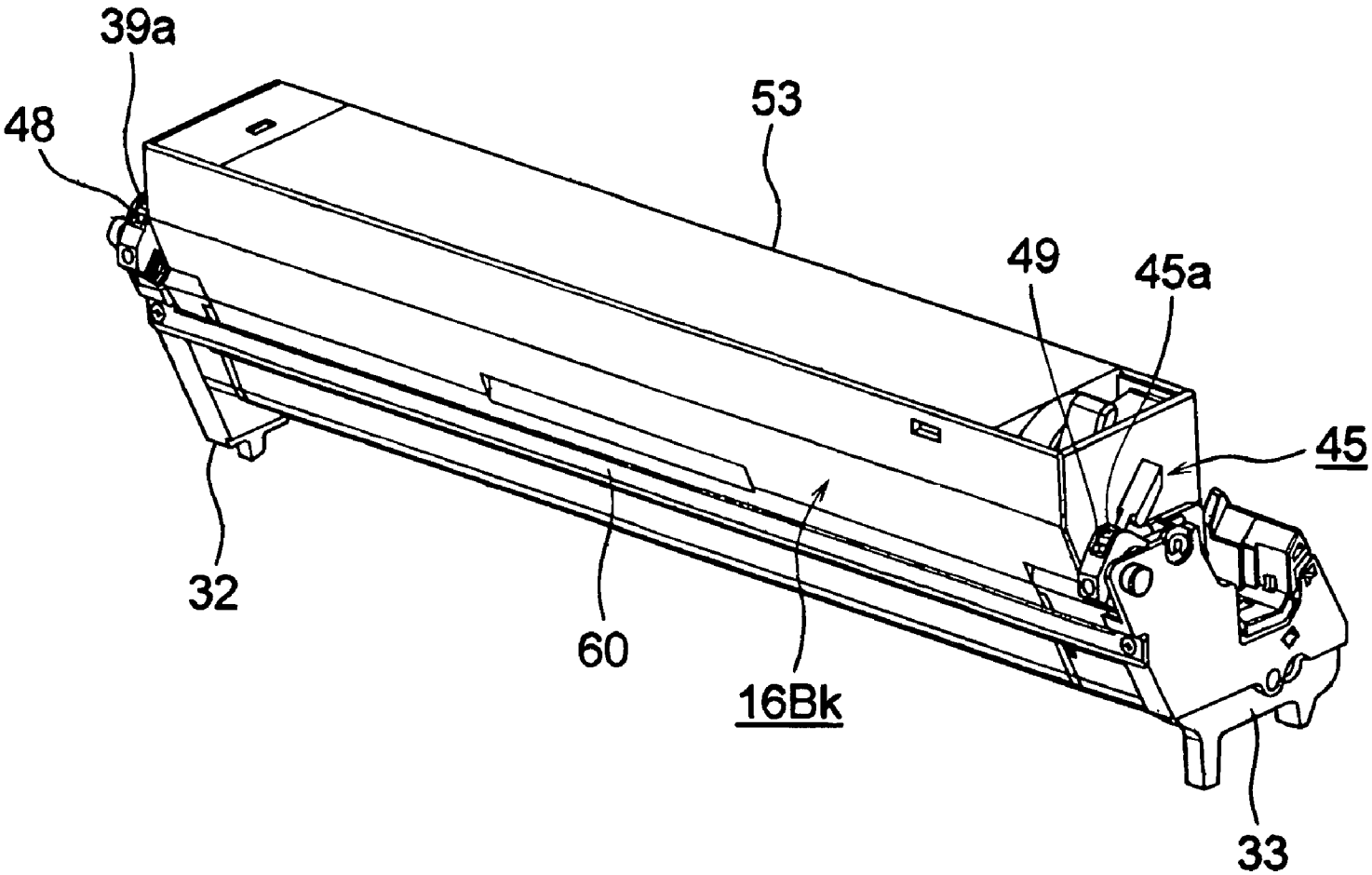
FIG. 3 is a schematic perspective view showing the image forming unit according to the first embodiment of the present invention.
Figure 4:
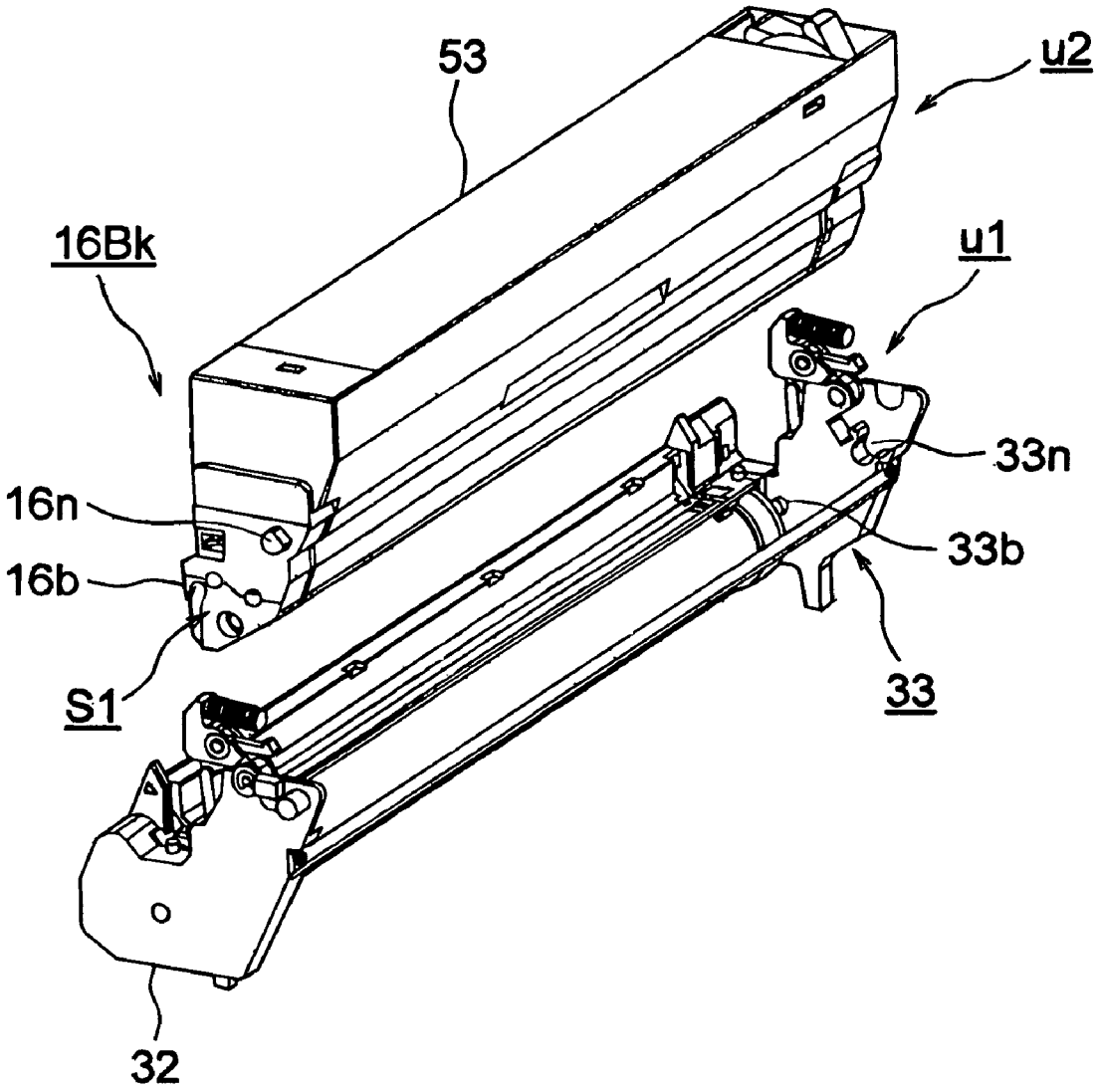
FIG. 4 is a schematic exploded perspective view No. 2 showing the image forming unit according to the first embodiment of the present invention.

FIG. 1 is a schematic exploded perspective view No. 1 showing the image forming unit 16Bk according to the first embodiment of the present invention. FIG. 3 is a schematic perspective view showing the image forming unit 16Bk according to the first embodiment of the present invention. FIG. 4 is a schematic exploded perspective view No. 2 showing the image forming unit 16Bk according to the first embodiment of the present invention.

As shown in FIG. 1, the image forming unit 16Bk includes an image supporting member unit u1 as a first unit; a developing roller unit u2 as a developer supporting member unit or a second unit disposed to be detachable relative to the image supporting member unit u1; and a toner cartridge 53 disposed to be detachable relative to the developing roller unit u2. The image supporting member unit u1 and the developing roller unit u2 constitute a main body of the image forming unit 16Bk or an image forming unit main body.

In the image supporting member unit u1, the photosensitive drum 52Bk is disposed between a side plate 32 on a left side (a left side in a direction that the sheet is transported) and a side plate 33 on a right side (a left right in a direction that the sheet is transported). A cover 35 is disposed on a front side of the image supporting member unit u1 for covering the photosensitive drum 52Bk. A beam 60 as a connecting member connects the side plate 32 and the side plate 33 at rear end portions 32*a* and 33*a* thereof.

In the embodiment, a post 41 is attached to a shaft portion 32*c* of the side plate 32, so that a holder 36 as a rotational member is disposed to be rotatable relative to the side plate 32 around the post 41 as a pivot. A post 40 is attached to the holder 36, so that a lock lever 39 as a locking member is disposed to be rotatable relative to the holder 36.

In the embodiment, a pushdown member 37 is attached to a distal end portion 36*a* of the holder 36, and a compression spring 38 as a first urging member or an image forming member urging member is arranged around the pushdown member 37 to be freely extend and contract. An engaging portion (not shown) is formed on the pushdown member 37 for engaging the holder 36, thereby preventing the pushdown member 37 from coming off. A compression spring 48 as a second urging member or a locking member urging member is arranged between a pressing portion 39*a* of the lock lever 39 and the holder 36.

In the embodiment, a post 47 is attached to a shaft portion 33*c* of the side plate 33, so that a holder 42 as a rotational member is disposed to be rotatable relative to the side plate 33 around the post 47 as a pivot. A post 46 is attached to the holder 42, so that a lock lever 45 as a locking member is disposed to be rotatable relative to the holder 42.

In the embodiment, a pushdown member 43 is attached to a distal end portion 42*a* of the holder 42, and a compression spring 44 as a first urging member is arranged around the pushdown member 43 to be freely extend and contract. An engaging portion (not shown) is formed on the pushdown member 43 for engaging the holder 42, thereby preventing the pushdown member 43 from coming off. A compression spring 49 as a second urging member is arranged between a pressing portion 45*a* of the lock lever 45 and the holder 42.

In the image supporting member unit u1, the side plate 32 includes a groove portion 32*n* and a protruding portion 32*b*, and the side plate 33 includes a groove portion 33*n* and a protruding portion 33*b*, so that the developing roller unit u2 is attached to the image supporting member unit u1. In the developing roller unit u2, a left side end surface S1 includes a protruding portion 16*n* and a groove portion 16*b*, and a right side end surface S2 includes a protruding portion 16*m* and a groove portion 16*c*. The protruding portions 16*n*, 16*m*, 32*b*, and 33*b* constitute engaging members, and the groove portions 16*b*, 16*c*, 32*n*, and 33*n* constitute engaged members.

An operation of assembling the image forming unit 16Bk will be explained next. An operation of assembling a left portion of the image forming unit 16Bk is the same as that of a right portion thereof, and only the operation of assembling the left portion of the image forming unit 16Bk will be explained.

Figure 5:
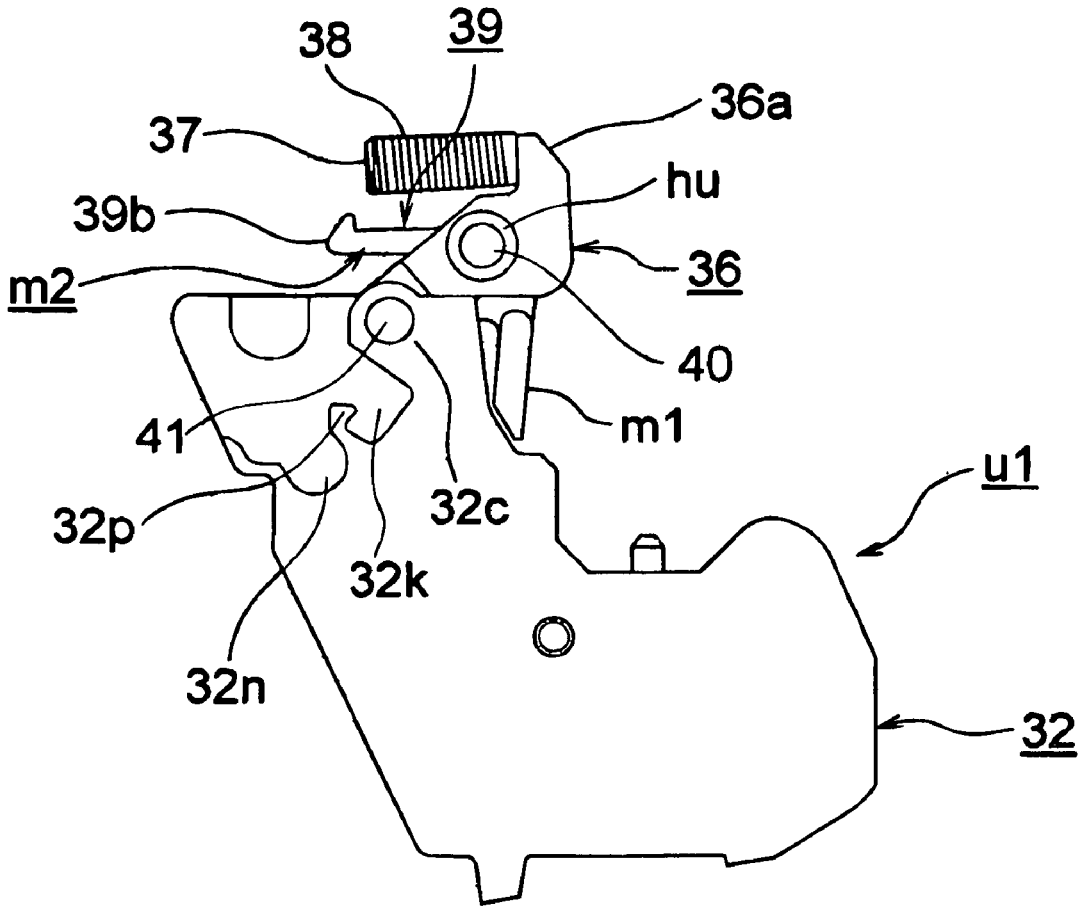
FIG. 5 is a schematic view showing an image supporting unit in an initial state according to the first embodiment of the present invention.
Figure 6:
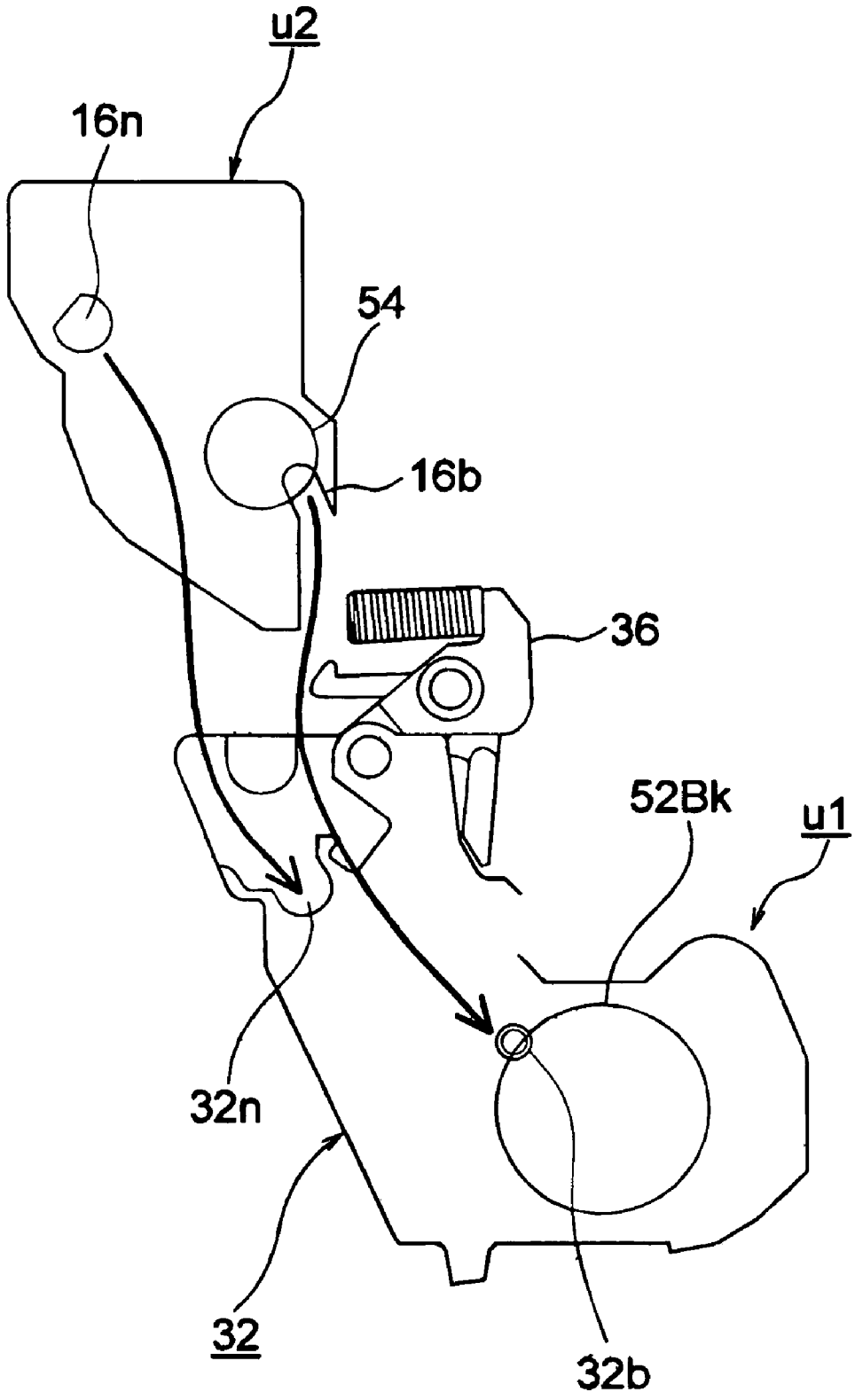
FIG. 6 is a schematic view No. 1 showing the image supporting unit in a state that a developing roller unit is attached thereto according to the first embodiment of the present invention.
Figure 7:
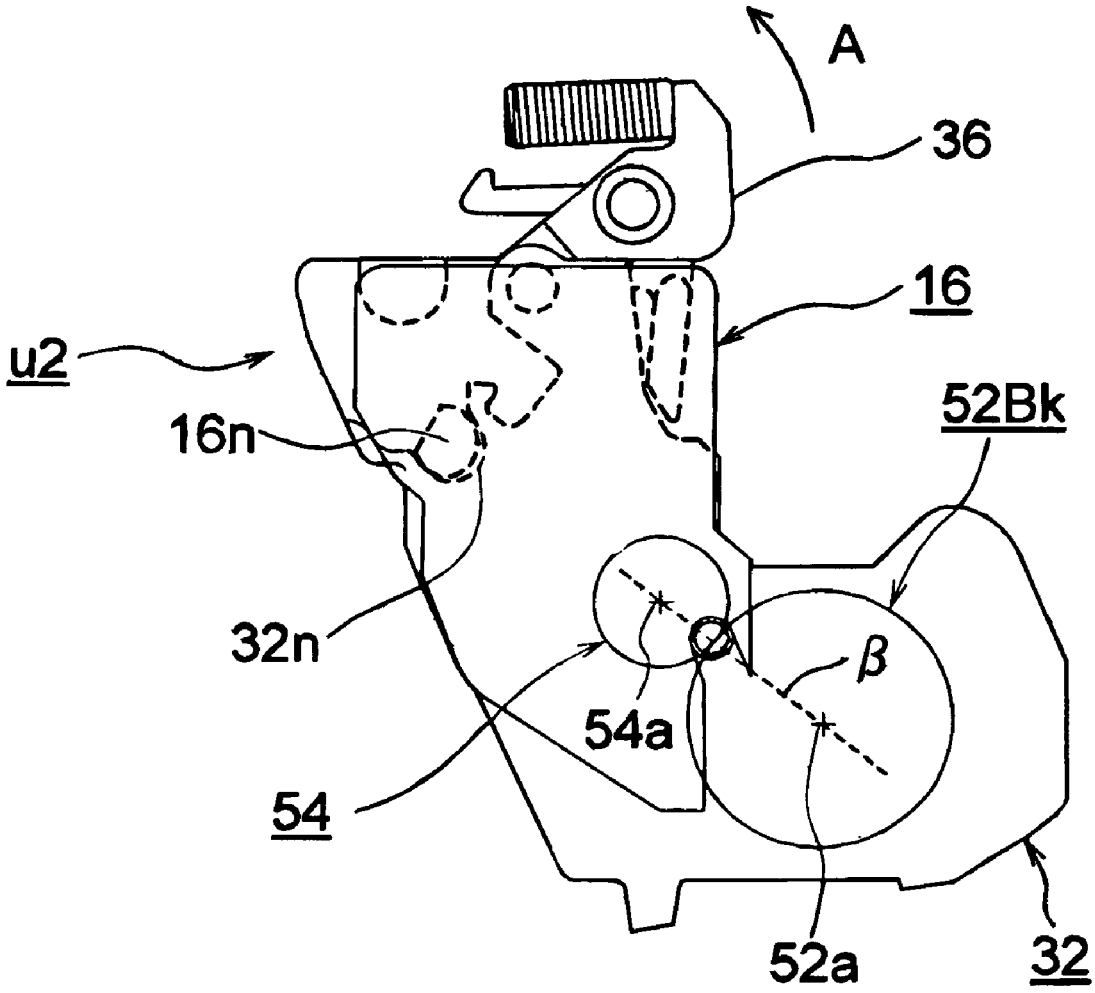
FIG. 7 is a schematic view No. 2 showing the image supporting unit in a state that a developing roller unit is attached thereto according to the first embodiment of the present invention.
Figure 8:
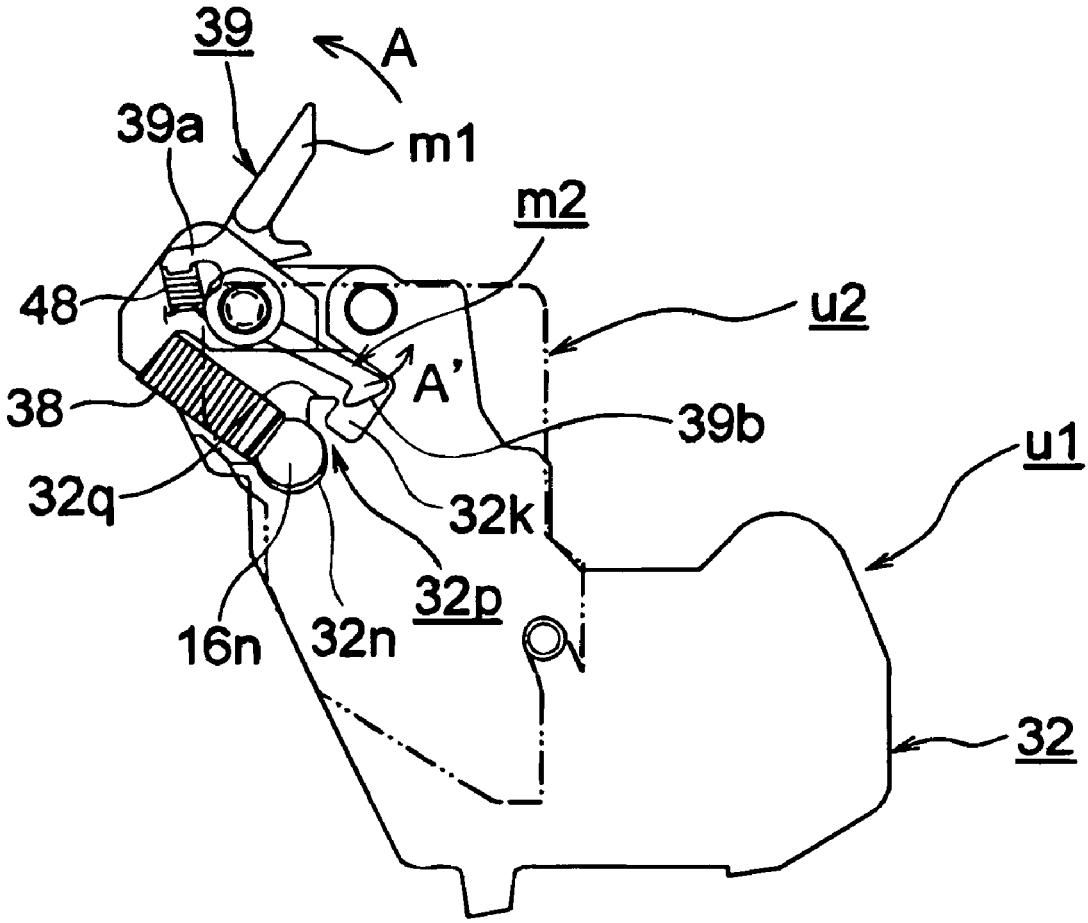
FIG. 8 is a schematic view No. 1 showing an operation of a holder and a lock lever according to the first embodiment of the present invention.
Figure 9:
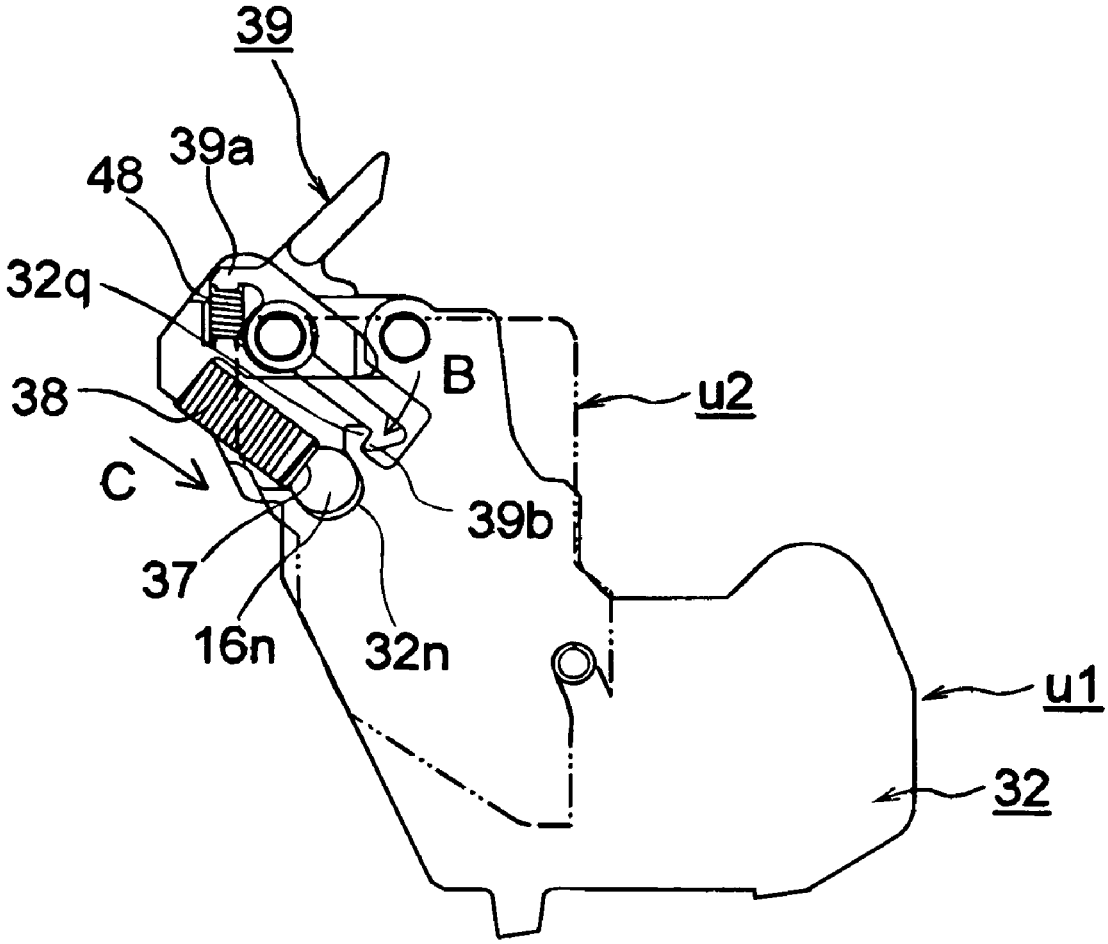
FIG. 9 is a schematic view No. 2 showing the operation of the holder and the lock lever according to the first embodiment of the present invention.

FIG. 5 is a schematic view showing the image supporting unit u1 in an initial state according to the first embodiment of the present invention. FIG. 6 is a schematic view No. 1 showing the image supporting unit u1 in a state that a developing roller unit is attached thereto according to the first embodiment of the present invention. FIG. 7 is a schematic view No. 2 showing the image supporting unit u1 in a state that the developing roller unit u2 is attached thereto according to the first embodiment of the present invention. FIG. 8 is a schematic view No. 1 showing an operation of the holder 36 and the lock lever 39 according to the first embodiment of the present invention. FIG. 9 is a schematic view No. 2 showing the operation of the holder 36 and the lock lever 39 according to the first embodiment of the present invention.

As shown in FIG. 5, when the image supporting member unit u1 is in the initial state, the holder 36 and the lock lever 39 are in a released state, and the compression spring 38 and the compression spring 48 are in an extended state, thereby generating no urging force. Note that when the compression spring 48 is in the extended state, the lock lever 39 protrudes in parallel relative to the pushdown member 37 and the compression spring 38.

In the embodiment, the lock lever 39 includes a lever m1 as a handle portion protruding from a hub portion hu surrounding the post 40; an arm portion m2 protruding from the lever m1 at a right angle; the pressing portion 39*a* protruding near the hub portion hu; and a hook 39*b* as an engaging member formed at a distal end portion of the arm portion m2.

In the embodiment, a retaining portion 32K is formed in the side plate 32 adjacent to the groove portion 32*n*. A protruding portion 32*p* is formed between the groove portion 32*n* and the retaining portion 32*k* to protrude upwardly. A hook 32*q* as an engaged member is formed at a distal end portion of the protruding portion 32*p*.

As shown in FIG. 6, the groove portion 16*b* of the developing roller unit u2 is fitted into and engages the protruding portion 32*b* of the side plate 32. The groove portion 16*c* of the developing roller unit u2 (refer to FIG. 1) is fitted into and engages the protruding portion 33*b* of the side plate 33 (refer to FIG. 4). The protruding portion 16*n* of the developing roller unit u2 is fitted into and engages the groove portion 32*n* of the side plate 32. The protruding portion 16*m* of the developing roller unit u2 (refer to FIG. 1) is fitted into and engages the groove portion 33*n* of the side plate 33 (refer to FIG. 4). Accordingly, the developing roller unit u2 is attached to the image supporting member unit u1.

At this time, as shown in FIG. 7, a developing roller 54 as a second image forming member or a developer supporting member abuts against the photosensitive drum 52Bk.

When the holder 36 rotates in an arrow direction A in FIG. 7, a distal end portion of the compression spring 38 abuts against the protruding portion 16*n*, so that the compression spring 38 urges the protruding portion 16*n* with a specific urging force toward a bottom portion of the groove portion 32*n*. The arm m2 abuts against the protruding portion 32*p*.

As described above, the lock lever 39 is disposed to be freely rotatable relative to the holder 36. Accordingly, when the holder 36 rotates further in the arrow direction A, the rotation is restricted in a state that the holder 36 abuts against the protruding portion 32*p*, thereby compressing the compression spring 48.

When the holder 36 reaches at a specific position, as shown in FIG. 8, the hook 39*b* rotates in an arrow direction A' to move over the hook 32*q* and enter the retaining portion 32*k*. Accompanied with this motion, the restriction on the rotation of the lock lever 39 is released. Accordingly, as shown in FIG. 9, the lock lever 39 rotates in an arrow direction B with the urging force of the compression spring 48, so that the hook 39*b* engages the hook 32*q*. As a result, the developing roller unit u2 is attached to the image supporting member unit u1, and the lock lever 39 is locked.

As shown in FIG. 9, the compression spring 38 urges the protruding portion 16*n* with a specific urging force in an arrow direction C toward the bottom portion of the groove portion 32*n*. As shown in FIG. 7, it is supposed that a straight line β is drawn between an axial portion 54*a* of the developing roller 54 and an axial portion 52*a* of the photosensitive drum 52Bk. The straight line β extends in parallel to the arrow direction C, and the urging force of the compression spring 38 is applied on the straight line β.

In the embodiment, it is preferred that an angle γ between the urging force of the compression spring 38 and the straight line β is equal to or greater than zero degree and equal to or smaller than 15 degrees. More preferably, it is configured such that the angle γ is equal to zero. In the preferred case, the developing roller 54 is properly pressed against the photosensitive drum 52Bk, and it is possible to properly set a distance between the axial portions 52*a* and 54*a*. Accordingly, it is possible to accurately obtain a nip amount between the photosensitive drum 52Bk and the developing roller 54, thereby improving image quality.

When the angle γ becomes greater than 15 degrees, the developing roller 54 is not properly pressed against the photosensitive drum 52Bk. Accordingly, it is difficult to accurately obtain the nip amount, thereby deteriorating image quality.

When the printer is in the initial state, it is configured that there are specific clearances between the protruding portion 16*n* and the bottom portion of the groove portion 32*n*, and between the protruding portion 32*b* and a bottom portion of the groove portion 16*b*. Accordingly, even when an outer diameter of the photosensitive drum 52Bk or the developing roller 54 decreases due to surface ware after the printer is used for a long period of time, the protruding portion 16*n* moves closer to the bottom portion of the groove portion 32*n*, and the protruding portion 32*b* moves closer to the bottom portion of the groove portion 16*b*. As a result, it is still possible to accurately obtain the nip amount, thereby improving image quality.

Second Embodiment

A second embodiment of the present invention will be described below. In the description below, elements in the second embodiment similar to those in the first embodiment are designated by same reference numerals, and explanations thereof are omitted. Explanations of operations and effects in the second embodiment similar to those in the first embodiment are omitted.

Figure 10:
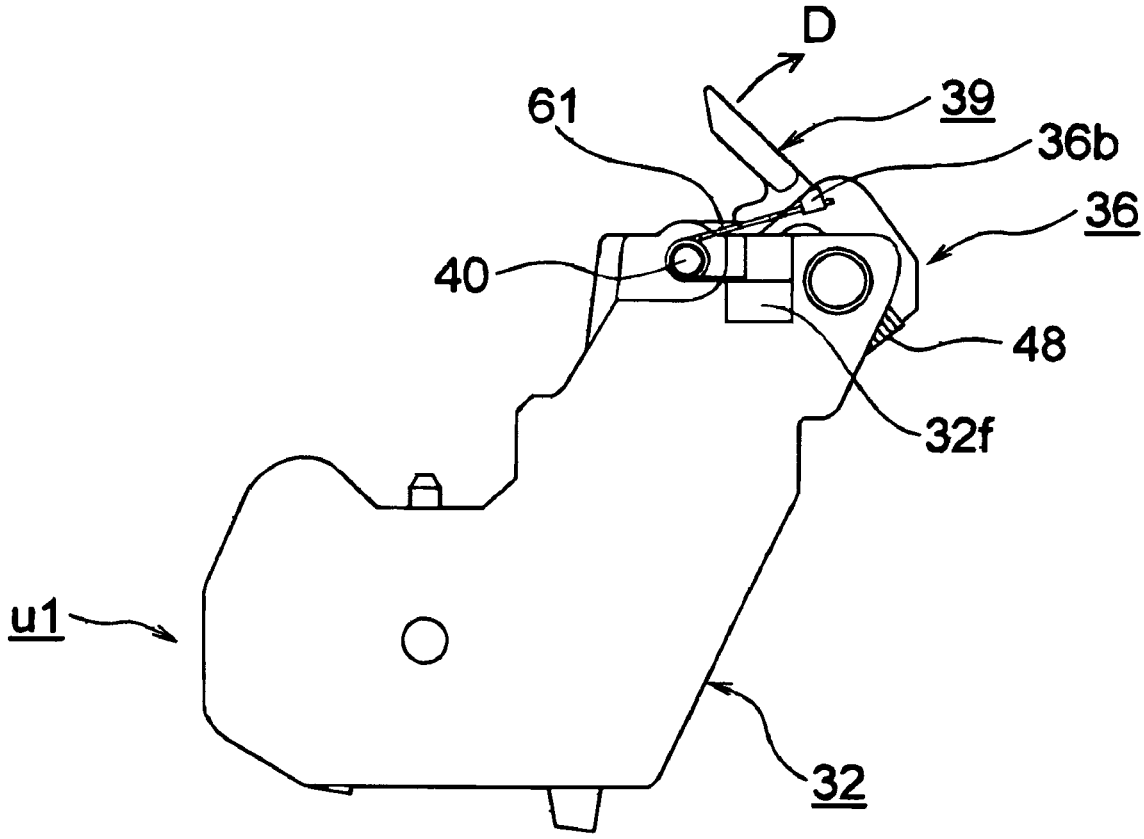
FIG. 10 is a schematic side view showing a lock lever in a locked state according to a second embodiment of the present invention.
Figure 11:
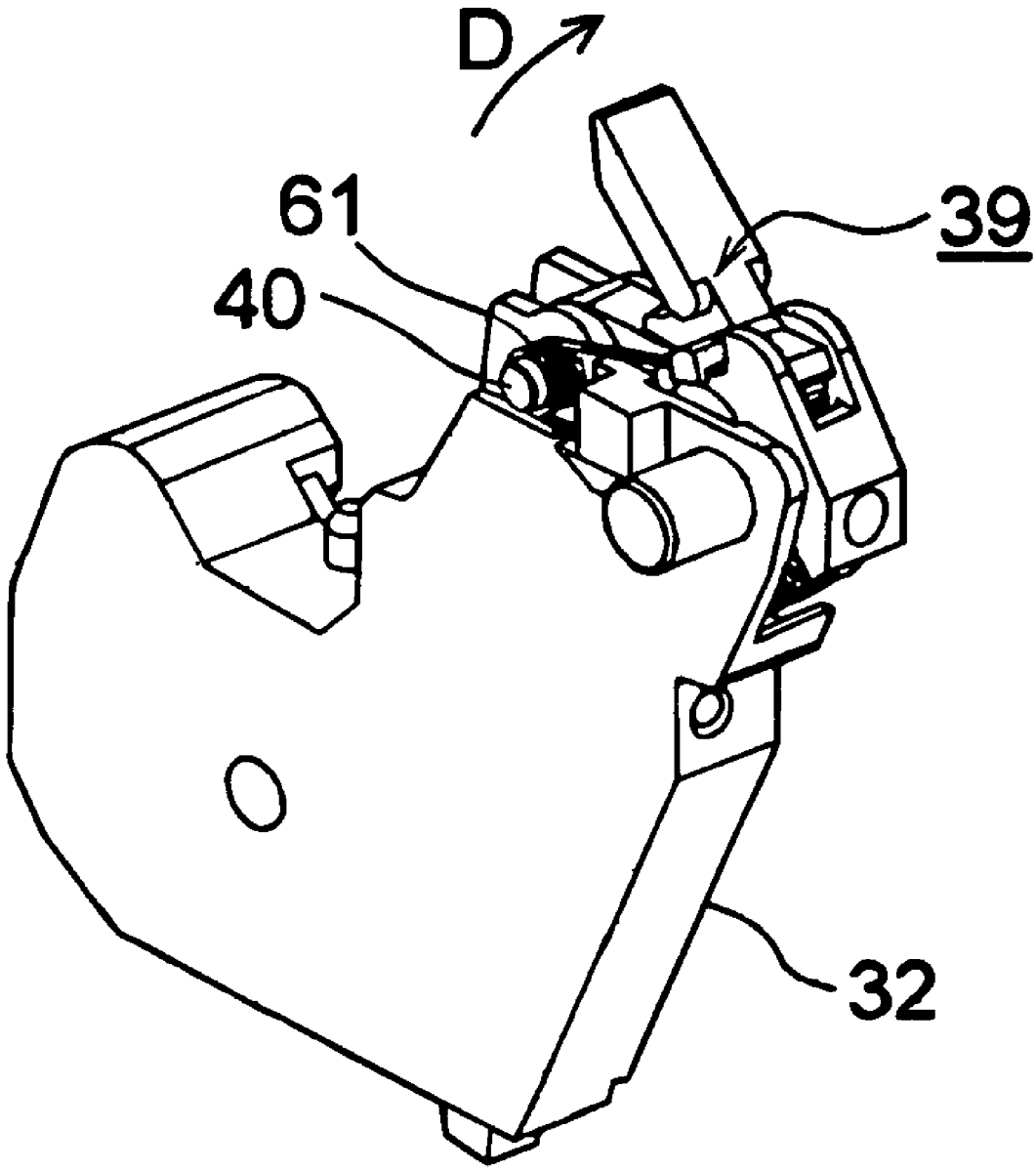
FIG. 11 is a schematic perspective view showing the lock lever in the locked state according to a second embodiment of the present invention.
Figure 12:
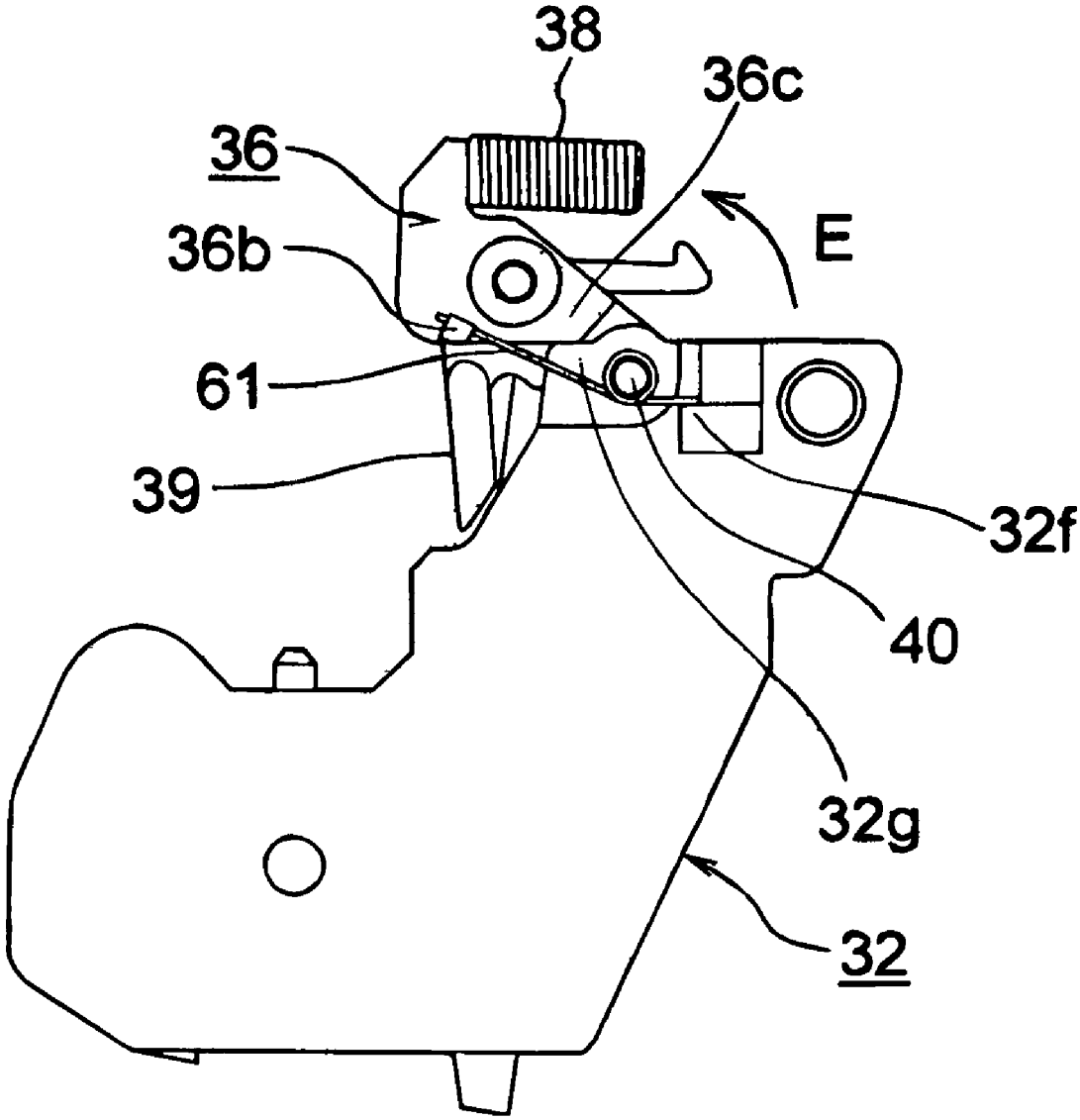
FIG. 12 is a schematic side view showing the lock lever in a released state according to a second embodiment of the present invention.
Figure 13:
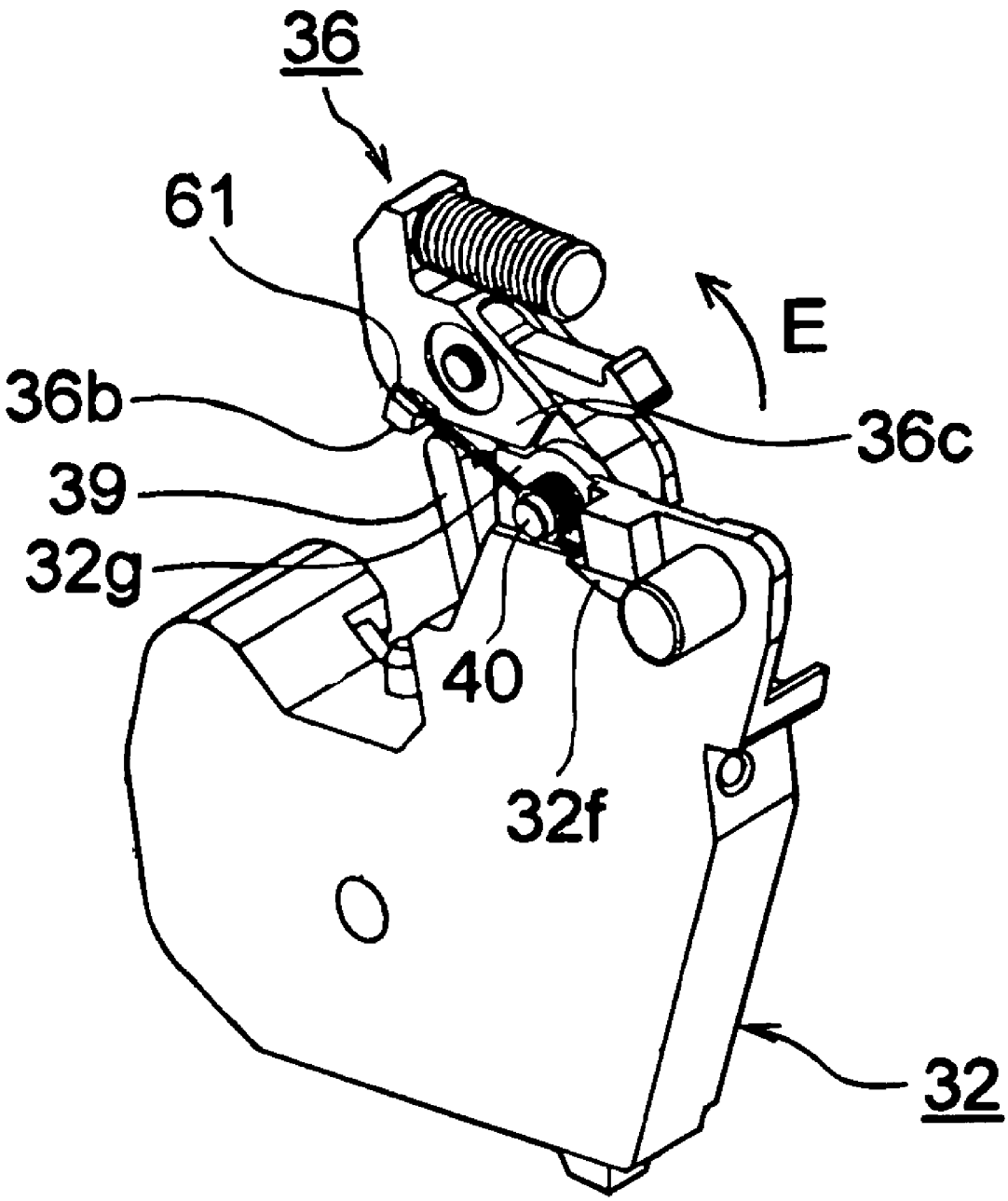
FIG. 13 is a schematic perspective view showing the lock lever in the released state according to a second embodiment of the present invention.

FIG. 10 is a schematic side view showing the lock lever 39 in a locked state according to the second embodiment of the present invention. FIG. 11 is a schematic perspective view showing the lock lever 39 in the locked state according to a second embodiment of the present invention. FIG. 12 is a schematic side view showing the lock lever 39 in a released state according to a second embodiment of the present invention. FIG. 13 is a schematic perspective view showing the lock lever 39 in the released state according to a second embodiment of the present invention.

As shown in FIGS. 10 and 11, a torsion spring 61 is attached to the post 40. One end portion of the torsion spring 61 engages a hook 36*b* as a first engaging portion formed at a specific position of the holder 36 as the rotational member. The other end portion of the torsion spring 61 engages a regulating portion 32*f* as a second engaging portion formed at a specific position of the side plate 32. The torsion spring 61 urges the holder 36 with a specific urging force in a direction that the lock lever 39 is released from the locked state.

An operation of the developing roller unit u2 will be explained next. As shown in FIGS. 12 and 13, after the lock lever 39 rotates in an arrow direction D to lock, when the lock lever 39 rotates in an opposite direction to release from the locked state to remove the developing roller unit u2 from the image supporting member unit u1 (refer to FIG. 1), the lock lever 39 rotates in an arrow direction E with the urging force of the torsion spring 61. Accordingly, a limiter portion 36*c* of the holder 36 as a regulated portion abuts against a limiter portion 32*g* of the side plate 32 as a regulating portion, and stops.

In the embodiment, as described above, when the lock lever 39 is released from the locked state, the lock lever 39 rotates. Accordingly, after the developing roller unit u2 is removed from the image supporting member unit u1, it is possible to attach the developing roller unit u2 to the image supporting member unit u1 through the simple operation.

Third Embodiment

A third embodiment of the present invention will be described below. In the description below, elements in the third embodiment similar to those in the first and second embodiments are designated by same reference numerals, and explanations thereof are omitted. Explanations of operations and effects in the third embodiment similar to those in the first and second embodiments are omitted.

Figure 14:
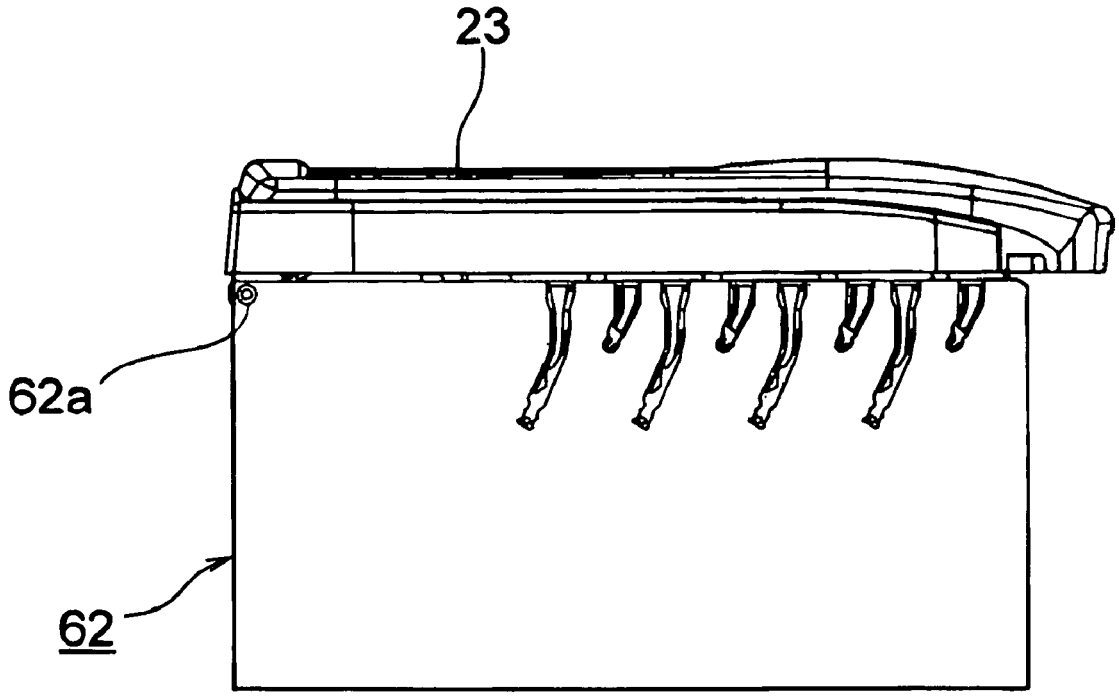
FIG. 14 is a schematic side view showing a plate side of a printer according to a third embodiment of the present invention.
Figure 15:
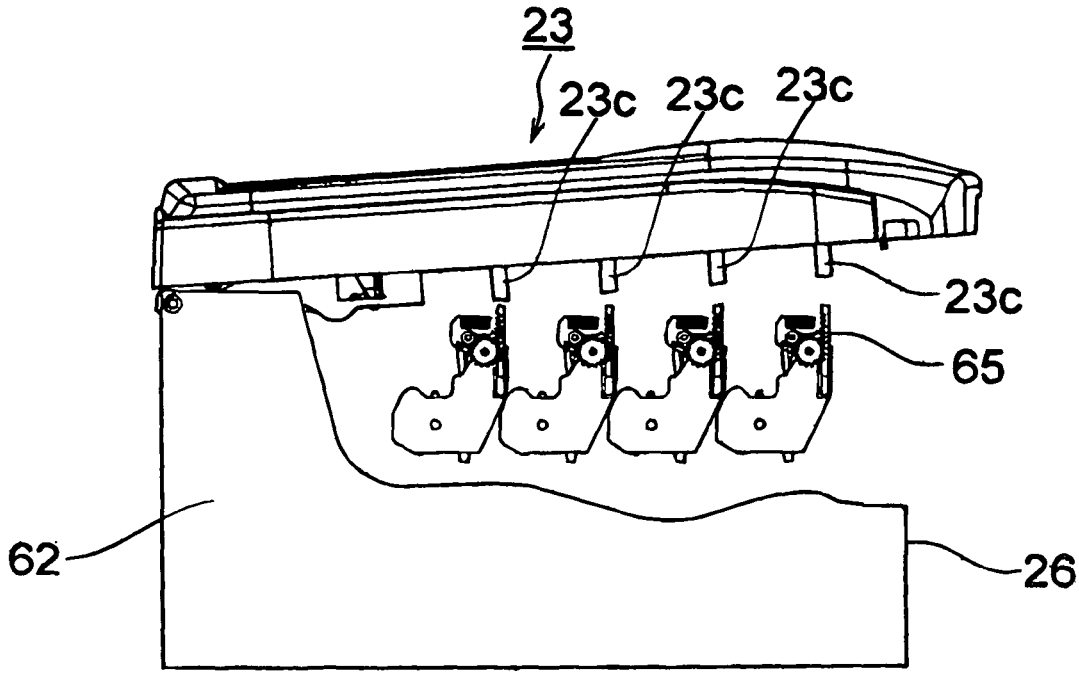
FIG. 15 is a schematic sectional view showing the printer in a state that a top cover is opened according to the third embodiment of the present invention.
Figure 16:
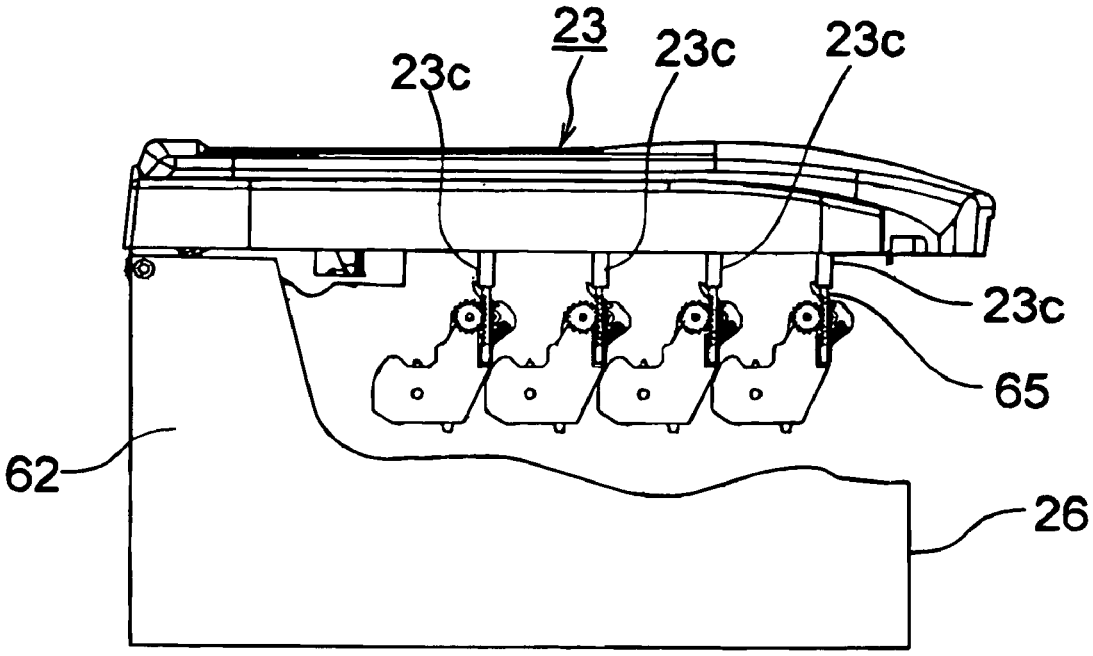
FIG. 16 is a schematic sectional view showing the printer in a state that the top cover is closed according to the third embodiment of the present invention.
Figure 17:
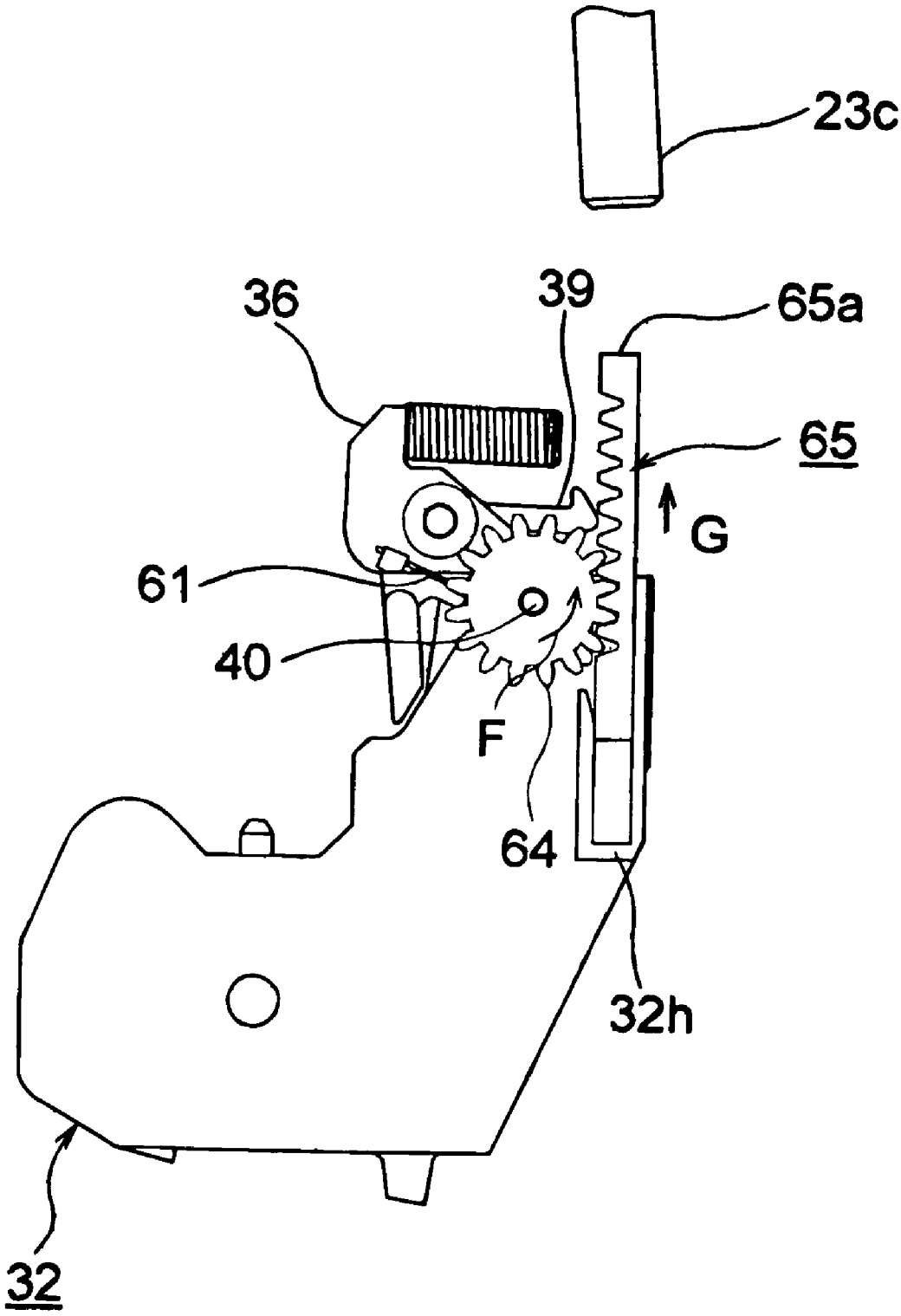
FIG. 17 is a schematic side view showing a lock lever in a state that the top cover is opened according to the third embodiment of the present invention.
Figure 18:
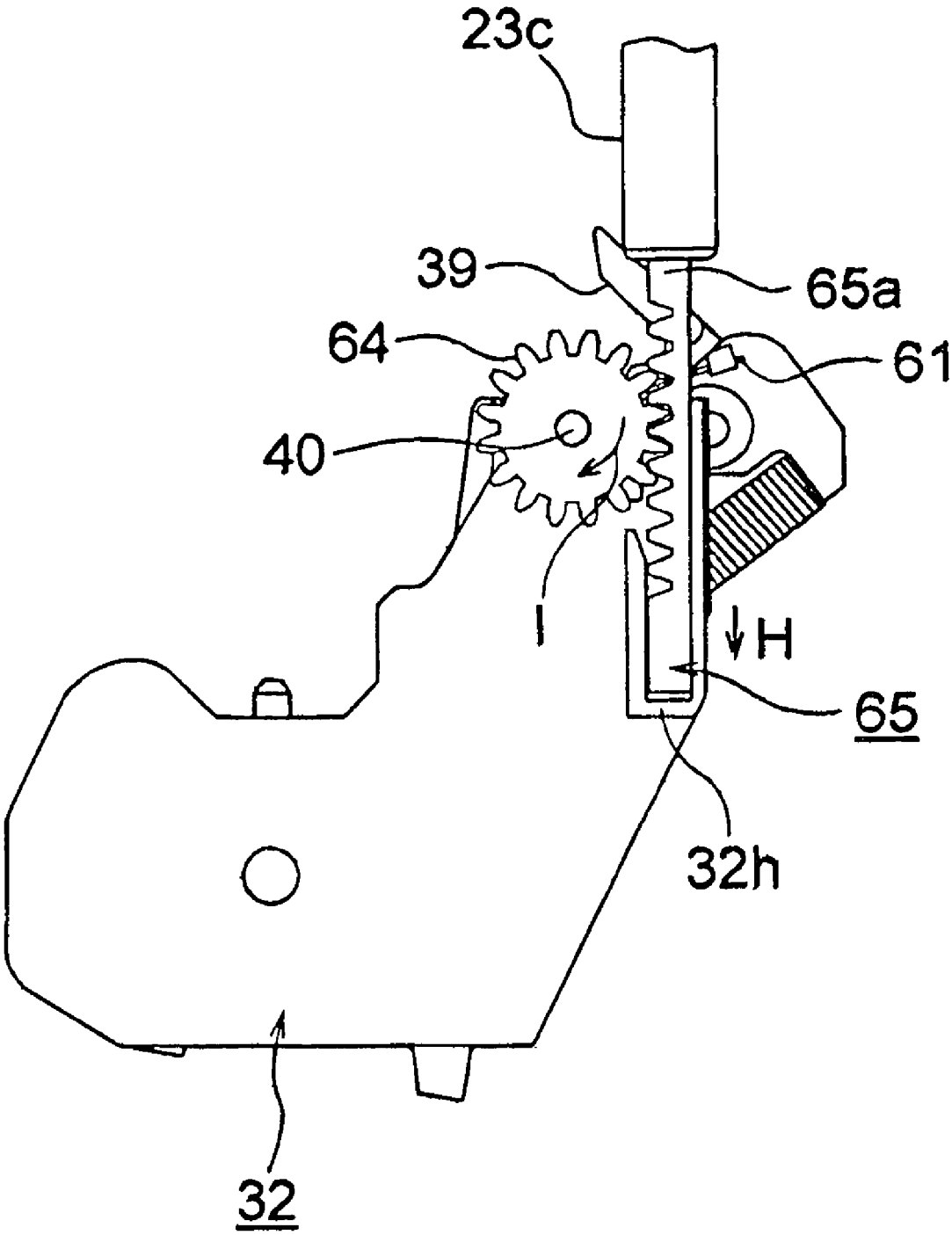
FIG. 18 is a schematic side view showing the lock lever in a state that the top cover is closed according to the third embodiment of the present invention.

FIG. 14 is a schematic side view showing a plate side 62 of a printer according to the third embodiment of the present invention. FIG. 15 is a schematic sectional view showing the printer in a state that the top cover 23 is opened according to the third embodiment of the present invention. FIG. 16 is a schematic sectional view showing the printer in a state that the top cover 26 is closed according to the third embodiment of the present invention. FIG. 17 is a schematic side view showing the lock lever 39 in a state that the top cover 26 is opened according to the third embodiment of the present invention. FIG. 18 is a schematic side view showing the lock lever 39 in a state that the top cover 26 is closed according to the third embodiment of the present invention.

Similar to the first embodiment, the image forming units 16Bk, 16Y, 16M, and 16C have an identical configuration, and only a configuration of the image forming unit 16Bk will be explained.

As shown in FIGS. 13 to 18, the printer includes the top cover 23 as a top wall portion or an opening-closing member; the plate side 62; and a rotational shaft 62*a* for supporting the plate side 62 to be freely rotatable relative to the top cover 23. The holder 36 is fixed to the post 40, and the torsion spring 61 is attached to an end portion of the post 40. A gear 64 is fixed outside, so that the holder 36 and the gear 64 are disposed on the side plate 32 to be freely and integrally rotatable with a shaft portion (not shown) as a pivot.

In the embodiment, a rack 65 as a lock mechanism operation member engages the gear 64 to be freely movable in a vertical direction. A guide 32*h* as a guide member is formed on the side plate 32 for guiding the rack 65, so that the rack 65 is slidable along the guide 32*h*. The rack 65 is restricted with a limiter (not shown) as a regulating member.

When the rack 65 is situated at an upper most position or an upper most end position, the lock lever 39 as a lock mechanism is released from the locked state. When the lock lever 39 is released, the rack 65 engages the gear 64.

In the embodiment, a protruding portion 23*c* as an abutting portion is formed on a lower surface of the top cover 23 to face an upper end portion 65*a* of the rack 65 in each of the image forming units 16Bk, 16Y, 16M, and 16C, so that the protruding portion 23*c* moves close to or away from the upper end portion 65*a*.

An operation of the image forming unit 16Bk will be explained next. When the lock lever 39 is released from the locked state in a state that the top cover 23 is opened, the lock lever 39 rotates with the urging force of the torsion spring 61, and becomes the state shown in FIG. 17. At this time, the gear 64 rotates in an arrow direction F (in a counterclockwise direction), and the rack 65 moves in an arrow direction G (downwardly) accompanied with the gear 64.

In this state, when the top cover 23 is closed, the protruding portion 23*c* pushes the upper end portion 65*a* downwardly. When the top cover 23 is closed further, the top cover 23 is locked with a lock portion (not shown) disposed between the top cover 23 and the housing. At this time, as shown in FIG. 18, the protruding portion 23*c* pushes the rack 65 in an arrow direction H (downwardly), and the torsion spring 61 rotates in an arrow direction I (in a clockwise direction), thereby locking the lock lever 39.

In the embodiment, even when an operator forgets to lock the lock lever 39, it is possible to lock the lock lever 39 through closing the top cover 23, thereby improving operability of the printer.

In the embodiments described above, the printer is explained as the image forming apparatus. The present invention is applicable to a copier, a facsimile, a multi-function product, and the likes.

The disclosure of Japanese Patent Application No. 2007-214436, filed on Aug. 21, 2007, is incorporated in the application.

While the invention has been explained with reference to the specific embodiments of the invention, the explanation is illustrative and the invention is limited only by the appended claims.

What is claimed is:

1. An image forming unit comprising:

a first image forming member;

a second image forming member;

a first unit for supporting the first image forming member to be freely rotatable;

a second unit for supporting the second image forming member to be freely rotatable;

an image forming member urging member attached to at least one of the first unit and the second unit for urging the second image forming member toward the first image forming member when the first unit is connected to the second unit; and a rotational member disposed on at least one of the first unit and the second unit to be freely rotatable for holding the image forming member urging member.

2. The image forming unit according to claim 1, wherein said first image forming member includes an image supporting member, said first unit including an image supporting member unit.

3. The image forming unit according to claim 1, wherein said second image forming member includes a developer supporting member, said second unit including a developer supporting member unit.

4. The image forming unit according to claim 1, further comprising a lock mechanism for locking the rotational member while the image forming member urging member urges the second image forming member toward the first image forming member.

5. The image forming unit according to claim 4, further comprising a lock mechanism urging member for urging the lock mechanism in a rotational direction that the image forming member urging member urges the second image forming member toward the first image forming member.

6. The image forming unit according to claim 5, wherein said lock mechanism urging member is formed of a compression spring.

7. The image forming unit according to claim 5, wherein said lock mechanism urging member is formed of a torsion spring.

8. The image forming unit according to claim 4, further comprising a lock mechanism operation member for locking the lock mechanism through a linear movement thereof.

9. An image forming apparatus comprising the image forming unit according to claim 4.

10. The image forming apparatus according to claim 9, further comprising a cover and a lock mechanism operation member arranged to be movable when the cover is opened and closed.

11. An image forming apparatus comprising the image forming unit according to claim 1.

12. The image forming unit according to claim 1, wherein said first unit includes a first engaging portion and a second engaging portion, and said second unit includes a third engaging portion for engaging the first engaging portion and a fourth engaging portion for engaging the second engaging portion.

13. The image forming unit according to claim 12, wherein one of said first engaging portion and said third engaging portion is formed in a protruding portion, and the other of said first engaging portion and said third engaging portion being formed in a groove portion.

14. The image forming unit according to claim 12, wherein one of said second engaging portion and said fourth engaging portion is formed in a protruding portion, and the other of said second engaging portion and said fourth engaging portion being formed in a groove portion.

15. The image forming unit according to claim 1, wherein said first unit includes a first engaging portion and a second engaging portion, said second unit including a third engaging portion for engaging the first engaging portion with a specific distance in between and a fourth engaging portion for engaging the second engaging portion with a specific distance in between when the first unit is connected to the second unit.

16. The image forming unit according to claim 1, wherein said image forming member urging member is arranged to urge the second image forming member toward the first image forming member in a direction inclined relative to a line between rotational centers of the first image forming member and the second image forming member by an angle of 0° to 15°.

17. The image forming unit according to claim 1, wherein said image forming member urging member is arranged to urge the second image forming member toward the first image forming member in a direction in parallel to a line between rotational centers of the first image forming member and the second image forming member.

* * * * *